US011231214B2

(12) United States Patent
Sishtla et al.

(10) Patent No.: US 11,231,214 B2
(45) Date of Patent: Jan. 25, 2022

(54) LOW PRESSURE INTEGRATED PURGE

(71) Applicant: Carrier Corporation, Palm Beach Gardens, FL (US)

(72) Inventors: Vishnu M. Sishtla, Manlius, NY (US); Zissis A. Dardas, Worcester, MA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 125 days.

(21) Appl. No.: 16/262,201

(22) Filed: Jan. 30, 2019

(65) Prior Publication Data

US 2019/0234661 A1 Aug. 1, 2019

Related U.S. Application Data

(60) Provisional application No. 62/623,673, filed on Jan. 30, 2018.

(51) Int. Cl.

| | |
|---|---|
| ***F25B 41/06*** | (2006.01) |
| ***F25B 43/04*** | (2006.01) |
| ***F25B 43/00*** | (2006.01) |
| ***F25B 49/02*** | (2006.01) |

(52) U.S. Cl.

CPC ..... *F25B 43/043* (2013.01); *F25B 43/003* (2013.01); *F25B 43/04* (2013.01); *F25B 49/02* (2013.01)

(58) Field of Classification Search

CPC ..... F25B 43/043; F25B 43/04; F25B 49/02
See application file for complete search history.

(56) References Cited

U.S. PATENT DOCUMENTS

| | | | |
|---|---|---|---|
| 5,031,410 | A | 7/1991 | Plzak et al. |
| 5,044,166 | A | 9/1991 | Wijmans et al. |
| 5,062,273 | A | 11/1991 | Lee et al. |
| 5,119,635 | A | 6/1992 | Harel |

(Continued)

FOREIGN PATENT DOCUMENTS

| | | | |
|---|---|---|---|
| JP | 2575966 | B2 | 1/1997 |
| JP | 2007139347 | A | 6/2007 |

(Continued)

OTHER PUBLICATIONS

European Search Report Issued In EP Application No. 19152595.5, dated Jun. 6, 2019, 9 Pages.

*Primary Examiner* — Elizabeth J Martin
*Assistant Examiner* — Nael N Babaa
(74) *Attorney, Agent, or Firm* — Cantor Colburn LLP

(57) ABSTRACT

A heating, ventilation, air conditioning and refrigeration system includes a heat transfer fluid circulation loop configured to circulate a refrigerant therethrough, a purge gas outlet in operable communication with the heat transfer fluid circulation loop and at least one gas permeable membrane having a first side in operable communication with the purge gas outlet and a second side. The membrane includes a plurality of pores of a size to allow passage of contaminants through the membrane, while restricting passage of the refrigerant through the membrane, and further restricting passage of a vapor phase corrosion inhibitor through the membrane. A purge unit is in operable communication with the second side of the permeable membrane configured to receive a purge gas from the permeable membrane.

16 Claims, 3 Drawing Sheets

(56) References Cited

U.S. PATENT DOCUMENTS

| | | | | |
|---|---|---|---|---|
| 5,487,765 | A | 1/1996 | Kedar et al. | |
| 6,055,821 | A | 5/2000 | Song et al. | |
| 6,128,916 | A | 10/2000 | Callahan et al. | |
| 6,606,881 | B1 | 8/2003 | Justin | |
| 6,952,938 | B2 | 10/2005 | Albertson | |
| 7,357,002 | B2 | 4/2008 | Yoshimi et al. | |
| 8,574,342 | B1 | 11/2013 | Flowe | |
| 2007/0101759 | A1 | 5/2007 | Matsuoka et al. | |
| 2007/0113581 | A1 | 5/2007 | Yoshimi et al. | |
| 2010/0326126 | A1* | 12/2010 | Seiler | F25B 15/14 62/497 |
| 2013/0283830 | A1 | 10/2013 | Jandal et al. | |
| 2013/0283832 | A1* | 10/2013 | Kujak | C09K 5/042 62/115 |
| 2015/0059383 | A1 | 3/2015 | Sakamoto et al. | |
| 2015/0107294 | A1 | 4/2015 | Matsuura et al. | |
| 2016/0025393 | A1 | 1/2016 | Rockwell | |
| 2016/0175740 | A1 | 6/2016 | Stark et al. | |
| 2018/0127954 | A1* | 5/2018 | Bravo | B01D 46/0036 |

FOREIGN PATENT DOCUMENTS

| | | | |
|---|---|---|---|
| JP | 2009152218 | A | 7/2009 |
| JP | 2011248298 | A | 12/2011 |
| JP | 2015014865 | A | 1/2015 |
| JP | 6123526 | B2 | 5/2017 |

* cited by examiner

LOW PRESSURE INTEGRATED PURGE

CROSS-REFERENCE TO RELATED APPLICATIONS

This application claims the benefit of U.S. Provisional Application No. 62/623,673, filed Jan. 30, 2018, which is incorporated herein by reference in its entirety.

BACKGROUND

This disclosure relates generally to chiller systems used in air conditioning systems, and more particularly to a purge system for removing contaminants from a refrigeration system.

Chiller systems such as those utilizing oil-free low pressure compressors may include sections that operate below atmospheric pressure. As a result, leaks in the chiller system may draw air into the system, contaminating the refrigerant. This contamination degrades the performance of the chiller system, and further may cause corrosion of internal components of the chiller system. To address this problem, existing low pressure chillers include a purge unit to remove contamination. The purge unit is typically an additional vapor-compression unit connected to the chiller system to remove the contaminants.

Further, many systems utilize a vapor phase corrosion inhibitor (VPCI) as an additive in the refrigerant to prevent corrosion of the internal components. The vapor phase corrosion inhibitor also aids in lubrication of compressor bearings. In many systems, the vapor phase corrosion inhibitor present in the condenser vapor may be purged with the air and moisture contaminants at the purge unit, thus reducing the concentration of vapor phase corrosion inhibitor in the system and subsequently increasing corrosion risk to the internal components.

BRIEF DESCRIPTION

In one embodiment, a heating, ventilation, air conditioning and refrigeration system includes a heat transfer fluid circulation loop configured to circulate a refrigerant therethrough, a purge gas outlet in operable communication with the heat transfer fluid circulation loop and at least one gas permeable membrane having a first side in operable communication with the purge gas outlet and a second side. The membrane includes a plurality of pores of a size to allow passage of contaminants through the membrane, while restricting passage of the refrigerant through the membrane, and further restricting passage of a vapor phase corrosion inhibitor through the membrane. A purge unit is in operable communication with the second side of the permeable membrane configured to receive a purge gas from the permeable membrane.

Additionally or alternatively, in this or other embodiments the plurality of pores have an average pore diameter of less than 0.50 nm.

Additionally or alternatively, in this or other embodiments the membrane includes a zeolite material.

Additionally or alternatively, in this or other embodiments the purge gas outlet directs the purge gas from a condenser of the heat transfer fluid circulation loop to the at least one gas permeable membrane.

Additionally or alternatively, in this or other embodiments the purge unit is one of a mechanical purge unit or a thermal purge unit.

Additionally or alternatively, in this or other embodiments the mechanical purge unit includes a purge tank, a purge evaporator of a purge vapor compression cycle located in the purge tank, a purge line configured to deliver the purge gas from the membrane to the purge tank, and a return line configured to return refrigerant to the evaporator after thermal energy exchange with a purge refrigerant flow at the purge evaporator.

Additionally or alternatively, in this or other embodiments the purge vapor compression cycle further includes a purge compressor, a purge condenser and a purge expansion valve operably connected to the purge evaporator and configured to circulate the purge refrigerant therethrough.

Additionally or alternatively, in this or other embodiments the thermal purge unit includes a purge condenser configured to receive purge gas from the membrane via a purge line, and a purge condenser coil configured to flow a purge refrigerant therethrough. The refrigerant is condensed at the purge condenser via thermal exchange with the purge refrigerant flowing through the purge coil.

Additionally or alternatively, in this or other embodiments the purge refrigerant is directed to the purge condenser from a condenser outlet of the condenser.

Additionally or alternatively, in this or other embodiments a purge return line is configured to direct the purge refrigerant to the evaporator after flowing through the purge condenser coil.

Additionally or alternatively, in this or other embodiments a vent line is configured to vent contaminants from the purge unit to ambient.

In another embodiment, a method of operating a heating, ventilation, air conditioning and refrigeration system includes circulating a refrigerant through a heat transfer fluid circulation loop, diverting a purge gas comprising contaminants from a purge gas outlet in the fluid circulation loop, and transferring the contaminants across a permeable membrane. The membrane includes a plurality of pores of a size to allow passage of contaminants through the membrane, while restricting passage of the refrigerant through the membrane, and further restricting passage of a vapor phase corrosion inhibitor through the membrane. The purge gas is urged from the permeable membrane to a purge unit, and refrigerant is separated from the contaminants at the purge unit. The refrigerant is directed to an evaporator of the heat transfer fluid circulation loop via a return line.

Additionally or alternatively, in this or other embodiments the purge gas is diverted from a condenser of the heat transfer fluid circulation loop via the purge gas outlet.

Additionally or alternatively, in this or other embodiments separating refrigerant from the contaminants at the purge unit includes flowing the purge gas from the permeable membrane to a purge tank, flowing a purge refrigerant through a purge evaporator located in the purge tank. The purge evaporator is an element of a purge vapor compression cycle. Thermal energy is exchanged between the purge gas and the purge refrigerant flowing through the purge evaporator, thereby separating the refrigerant from contaminants.

Additionally or alternatively, in this or other embodiments separating refrigerant from the contaminants at the purge unit includes flowing the purge gas from the permeable membrane to a purge condenser, urging a purge refrigerant through a purge condenser coil located in the purge condenser, and condensing the refrigerant from the purge gas via thermal energy exchange with the purge refrigerant at the purge condenser, thereby separating the refrigerant from the contaminants.

Additionally or alternatively, in this or other embodiments the purge refrigerant is urged through the purge condenser coil from a condenser outlet of a condenser of the heat transfer fluid circulation loop.

Additionally or alternatively, in this or other embodiments the purge refrigerant is flowed from the purge condenser coil to the evaporator of the heat transfer fluid circulation loop.

Additionally or alternatively, in this or other embodiments contaminants are vented to ambient via a vent line at the purge unit.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
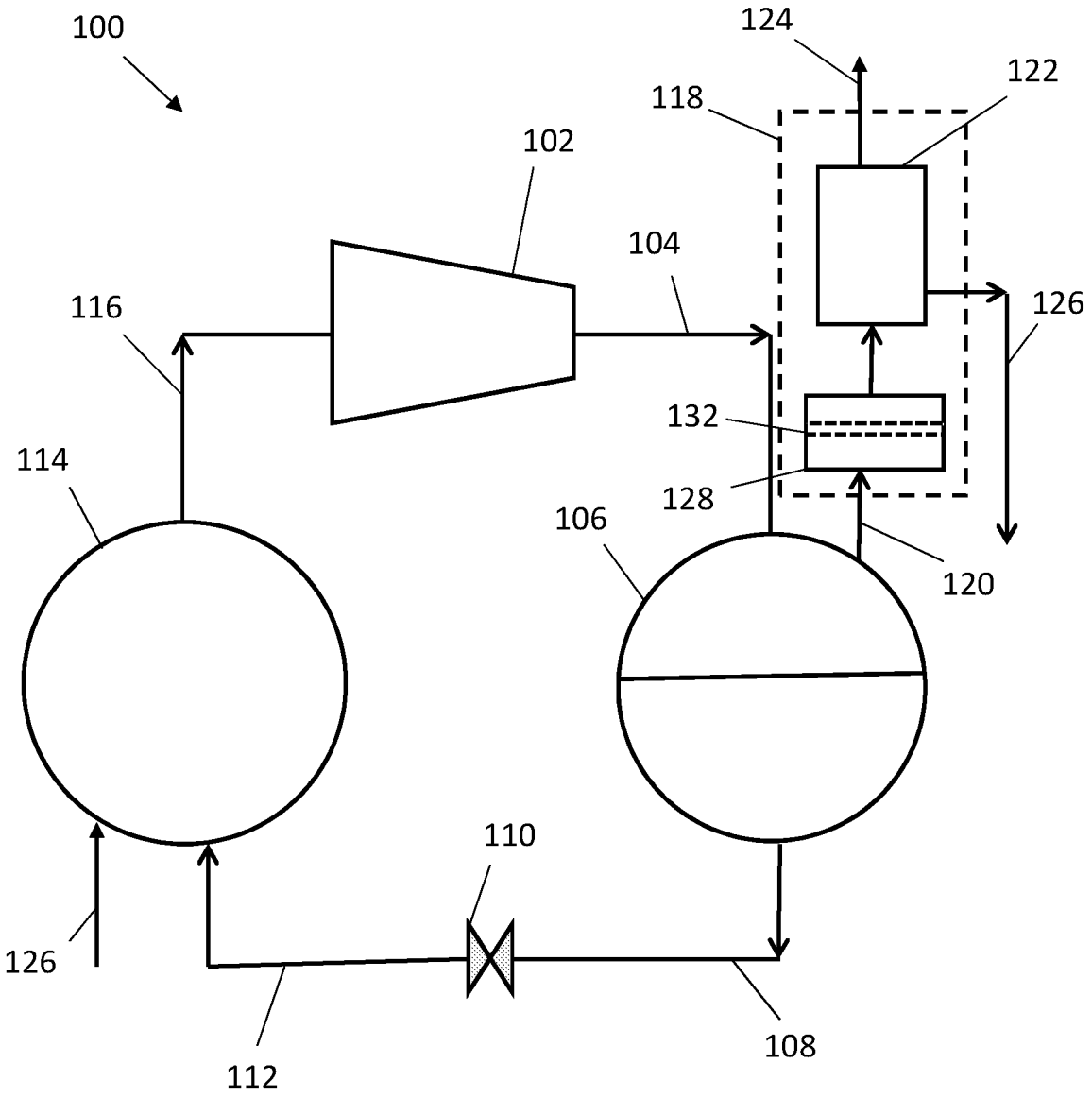
FIG. 1 is a schematic depiction of an embodiment of a heating, ventilation, air conditioning and refrigeration system including a vapor compression heat transfer refrigerant fluid circulation loop with a purge system.

With reference to FIG. 1, a heat transfer fluid circulation loop 100 such as can be used in a chiller or other heating, ventilation, air conditioning and refrigeration (HVAC&R) system, is shown in block diagram form in FIG. 1. As shown in FIG. 1, a compressor 102 pressurizes heat transfer fluid in its gaseous state, which both heats the fluid and provides pressure to circulate it throughout the system. In some embodiments, the heat transfer fluid, or refrigerant, comprises an organic compound. In some embodiments, the refrigerant comprises a hydrocarbon or substituted hydrocarbon. In some embodiments, the refrigerant comprises a halogen-substituted hydrocarbon. In some embodiments, the refrigerant comprises a fluoro-substituted or chloro-fluoro-substituted hydrocarbon. The hot pressurized gaseous heat transfer fluid exiting from the compressor 102 flows through conduit 104 to a condenser 106, which functions as a heat exchanger to transfer heat from the heat transfer fluid to the surrounding environment, resulting in condensation of the hot gaseous heat transfer fluid to a pressurized moderate temperature liquid. The liquid heat transfer fluid exiting from the condenser 106 flows through conduit 108 to an expansion valve 110, where the pressure is reduced. The reduced pressure liquid heat transfer fluid exiting the expansion valve 110 flows through conduit 112 to an evaporator 114, which functions as a heat exchanger to absorb heat from the surrounding environment and boil the heat transfer fluid. Gaseous heat transfer fluid exiting the evaporator 114 flows through conduit 116 to the compressor 102, thus completing the heat transfer fluid loop. The heat transfer system has the effect of transferring heat from the environment surrounding the evaporator 114 to the environment surrounding the condenser 106. The thermodynamic properties of the heat transfer fluid must allow it to reach a high enough temperature when compressed so that it is greater than the environment surrounding the condenser 106, allowing heat to be transferred to the surrounding environment. The thermodynamic properties of the heat transfer fluid must also have a boiling point at its post-expansion pressure that allows the temperature surrounding the evaporator 114 to provide heat to vaporize the liquid heat transfer fluid.

A purge system 118 is fluidly connected to the condenser 106 and utilized to remove contaminants, such as air and water moisture from the refrigerant stream. A purge line 120 extends from the condenser 106 to the purge system 118, through which vapor refrigerant flows to the purge system 118. The purge system 118 separates contaminants or non-condensables from the vapor refrigerant at a purge unit 122. The contaminants are released from the purge unit 112 via a vent line 124 to, for example, ambient. The refrigerant is returned to the fluid circulation loop 100 at, for example, the evaporator 114 via a return line 126.

A membrane purge unit 128 is located along the purge line 120 between the condenser 106 and the purge unit 122. The membrane purge unit 130 includes a membrane separator 132 configured to allow contaminants such as air, water, oxygen or nitrogen through the membrane separator 132 toward the purge unit 122 along the purge line 120, while preventing refrigerant and additives such as vapor pressure corrosion inhibitor (VPCI) present in the refrigerant from flowing through the membrane separator 132. Refrigerants utilized have an average molecular diameter of 0.54 nm, while VPCI additives are typically high molecular weight amines and their derivatives having larger molecular diameters. In some embodiments, the membrane separator 132 has a uniform pore size with an average pore diameter of less than 0.50 nm to prevent the refrigerant and VPCI additives from passing through the membrane separator 132 to the purge unit 122. This average pore diameter results in a membrane separator efficiency of approximately 90%.

In some embodiments, the membrane separator 132 comprises a porous inorganic material. Examples of porous inorganic materials can include ceramics such as metal oxides or metal silicates, more specifically aluminosilicates (e.g., Chabazite Framework (CHA) zeolite, Linde type A (LTA) zeolite), porous carbon, porous glass, clays (e.g., Montmorillonite, Halloysite). Porous inorganic materials can also include porous metals such as platinum and nickel. Hybrid inorganic-organic materials such as a metal organic frameworks (MOF) can also be used. Other materials can be present in the membrane such as a carrier in which a microporous material can be dispersed, which can be included for structural or process considerations. One skilled in the art will readily appreciate that the materials discussed herein are merely exemplary, and that other materials may be utilized.

Figure 2:
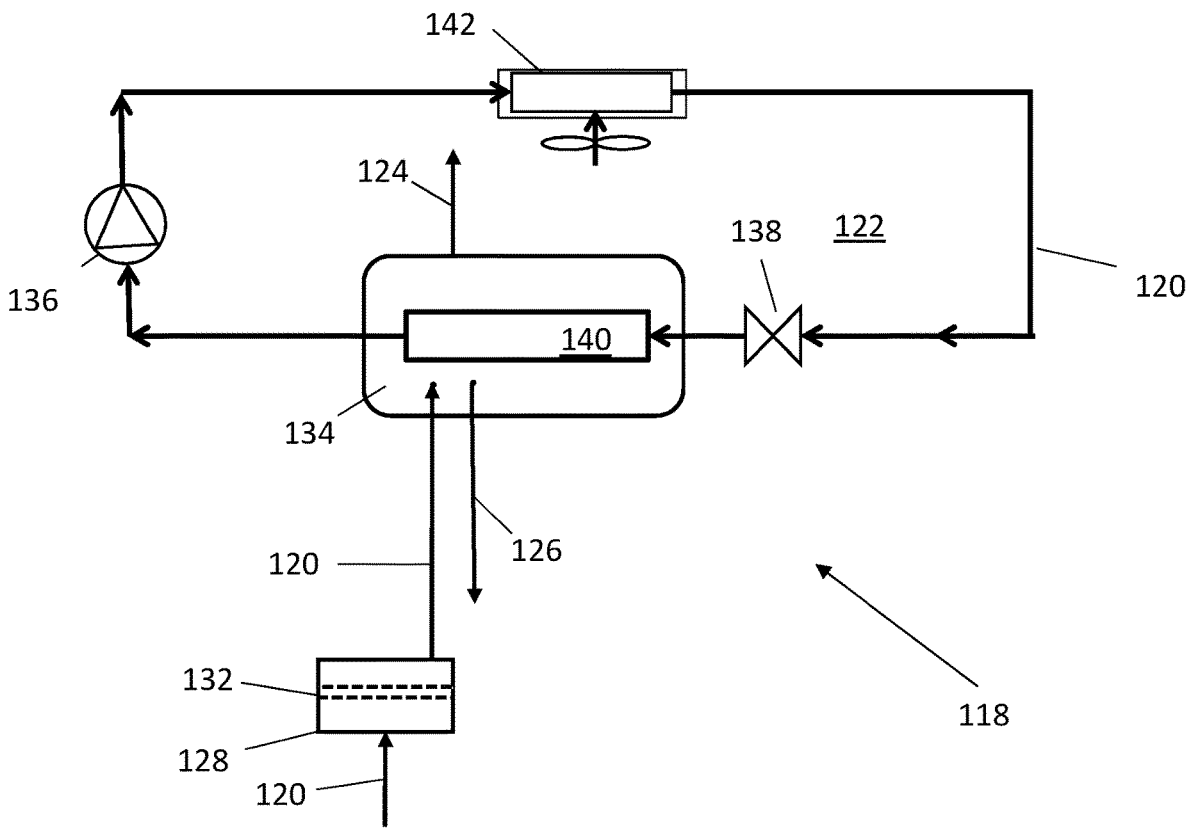
FIG. 2 is a schematic depiction of an example of a mechanical purge system for a heating, ventilation, air conditioning and refrigeration system.

Referring now to FIG. 2, in some embodiments the purge unit 122 is a mechanical purge unit 122, including a vapor compression cycle to remove the contaminants from the refrigerant. The purge unit 122 receives refrigerant and contaminants from the membrane separator 132 via the purge line 120. The purge line 120 directs the refrigerant into a purge tank 134, which is one element of a purge vapor compression cycle, including a purge compressor 136, a purge expansion valve 138, a purge evaporator 140 that resides in the purge tank 134, and a purge condenser 142, which may be air cooled or water cooled. The purge vapor compression cycle utilizes a purge refrigerant flow, which may be the same refrigerant material as the chiller refrigerant, or alternatively may be a different refrigerant material. At the purge evaporator 140, the purge refrigerant flow exchanges thermal energy with the chiller refrigerant, condenses at least a portion of the chiller refrigerant to a liquid, with a lesser degree of contaminants or non-condensables, which is directed back to the evaporator 114 via the return line 126.

Figure 3:
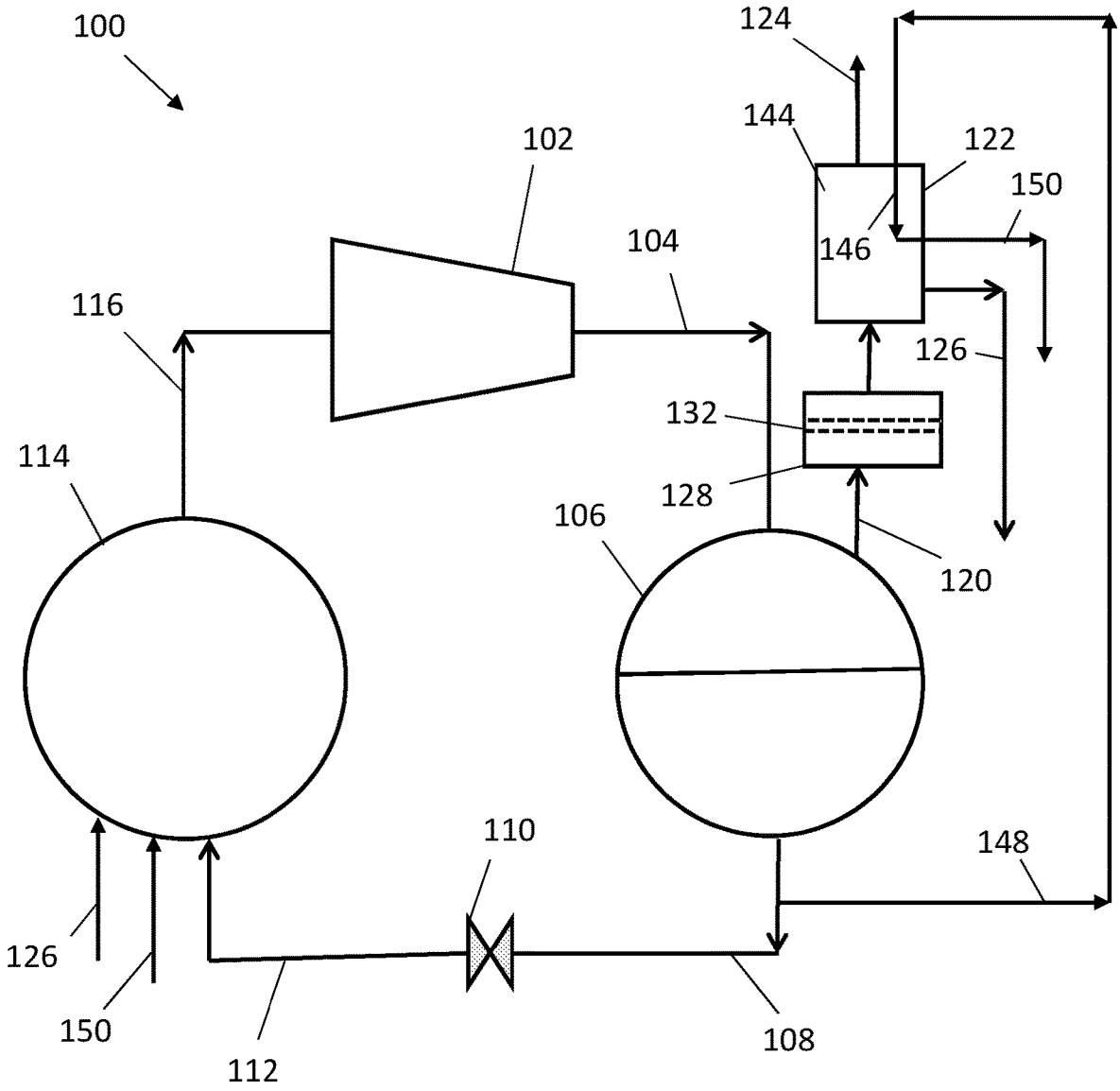
FIG. 3 is a schematic depiction of an embodiment of a heating, ventilation, air conditioning and refrigeration system including a vapor compression heat transfer refrigerant fluid circulation loop with a thermal purge system.

Referring now to FIG. 3, in another embodiment the purge unit 122 is a thermal purge unit 122. The thermal purge unit 122 includes a purge condenser 144, having a purge condenser coil 146 through which condensed refrigerant is directed from conduit 108 via purge condenser line 148. The vapor refrigerant flows from the purge line 120 into the purge condenser 144, where thermal energy exchange with the refrigerant in the condenser coil 146 condenses the refrigerant vapor into liquid. The condensed refrigerant liquid at the purge condenser 144 is returned to the evaporator 114 via the return line 126, while the non-condensables, such as air, water, and other materials are released from the purge unit 122 via the vent line 124. Refrigerant flowing through the purge condenser coil 146 is returned to the evaporator 114 via the coil return line 150.

Utilizing the membrane purge unit 128 in combination with the purge unit 122 allows for a size and/or operational capability of the purge unit 122 to be reduced, since the membrane purge unit 128 restricts entry of refrigerant into the purge unit 122. Further, the membrane purge unit 128 reduces depletion of the VPCI concentration in the refrigerant flow through the heat transfer fluid circulation loop 100.

The term "about", if used, is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating, ventilation, air conditioning and refrigeration system comprising:

a heat transfer fluid circulation loop configured to circulate a refrigerant therethrough;

a purge gas outlet in operable communication with the heat transfer fluid circulation loop;

at least one gas permeable membrane having a first side in operable communication with the purge gas outlet and a second side, said membrane comprising a plurality of pores of a size to allow passage of contaminants through the membrane, while restricting passage of the refrigerant through the membrane, and further restricting passage of a vapor phase corrosion inhibiter through the membrane; and a purge heat exchanger in operable communication with the second side of the permeable membrane, the purge heat exchanger configured to receive a purge gas from the permeable membrane, the purge heat exchanger located downstream of the permeable membrane such that a flow of purge gas from the purge gas outlet first flows across the permeable membrane before flowing through the purge heat exchanger;

wherein the purge gas outlet is located at a condenser of the heat transfer fluid circulation loop, and directs the flow of purge gas from the purge gas outlet to the at least one gas permeable membrane directly from the condenser; and further including a purge return line to direct the flow of purge gas to an evaporator of the heat transfer fluid circulation loop.

2. The heating, ventilation, air conditioning and refrigeration system of claim 1, wherein the plurality of pores have an average pore diameter of less than 0.50 nm.

3. The heating, ventilation, air conditioning and refrigeration system of claim 1, wherein the membrane includes a zeolite material.

4. The heating, ventilation, air conditioning and refrigeration system of claim 1, wherein the purge heat exchanger is a component of a mechanical purge unit, the mechanical purge unit including:

a purge tank;

a purge evaporator of a purge vapor compression cycle disposed in the purge tank;

a purge line configured to deliver the purge gas from the membrane to the purge tank; and a return line operably connected to the evaporator and configured to return refrigerant to the evaporator after thermal energy exchange with a purge refrigerant flow at the purge evaporator, wherein the purge heat exchanger is configured as the purge evaporator.

5. The heating, ventilation, air conditioning and refrigeration system of claim 4, wherein the purge vapor compression cycle further includes a purge compressor, a purge condenser and a purge expansion valve operably connected to the purge evaporator and configured to circulate the purge refrigerant therethrough.

6. A heating, ventilation, air conditioning and refrigeration system comprising:

a heat transfer fluid circulation loop configured to circulate a refrigerant therethrough;

a purge gas outlet in operable communication with the heat transfer fluid circulation loop;

at least one gas permeable membrane having a first side in operable communication with the purge gas outlet and a second side, said membrane comprising a plurality of pores of a size to allow passage of contaminants through the membrane, while restricting passage of the refrigerant through the membrane, and further restricting passage of a vapor phase corrosion inhibiter through the membrane; and a purge heat exchanger in operable communication with the second side of the permeable membrane, the purge heat exchanger configured to receive a purge gas from the permeable membrane, the purge heat exchanger located downstream of the permeable membrane such that a flow of purge gas from the purge gas outlet first flows across the permeable through the purge heat exchanger;

wherein the purge heat exchanger is a component of a thermal purge unit, the thermal purge unit including:

a purge condenser configured to receive purge gas from the membrane via a purge line; and a purge condenser coil configured to flow a purge refrigerant therethrough;

wherein the refrigerant is condensed at the purge condenser via thermal exchange with the purge refrigerant flowing through the purge coil;

wherein the purge heat exchanger is configured as the purge condenser.

7. The heating, ventilation, air conditioning and refrigeration system of claim 6, wherein the purge refrigerant is directed to the purge condenser from a condenser outlet of the condenser.

8. The heating, ventilation, air conditioning and refrigeration system of claim 6, further comprising a purge return line to direct the purge refrigerant to the evaporator after flowing through the purge condenser coil.

9. The heating, ventilation, air conditioning and refrigeration system of claim 1, further comprising a vent line to vent contaminants from the purge heat exchanger to ambient.

10. A method of operating a heating, ventilation, air conditioning and refrigeration system, comprising:

circulating a refrigerant through a heat transfer fluid circulation loop;

diverting a purge gas comprising contaminants from a purge gas outlet at a condenser of the fluid circulation loop;

transferring the contaminants across a permeable membrane directly from the condenser, said membrane comprising a plurality of pores of a size to allow passage of contaminants through the membrane, while restricting passage of the refrigerant through the membrane, and further restricting passage of a vapor phase corrosion inhibiter through the membrane; and urging the purge gas from the permeable membrane to a purge heat exchanger;

separating refrigerant from the contaminants at the purge heat exchanger; and directing the refrigerant to an evaporator of the heat transfer fluid circulation loop via a return line;

wherein the purge heat exchanger is located downstream of the permeable membrane such that the purge gas from the purge gas outlet first flows across the permeable membrane before flowing through the purge heat exchanger.

11. The method of claim 10, further comprising diverting the purge gas from a condenser of the heat transfer fluid circulation loop via the purge gas outlet.

12. The method of claim 10, wherein separating refrigerant from the contaminants at the purge heat exchanger includes:

flowing the purge gas from the permeable membrane to a purge tank; and flowing a purge refrigerant through a purge evaporator disposed in the purge tank, the purge evaporator an element of a purge vapor compression cycle;

exchanging thermal energy between the purge gas and the purge refrigerant flowing through the purge evaporator, thereby separating the refrigerant from contaminants;

wherein the purge heat exchanger is configured as the purge evaporator.

13. The method of claim 10, wherein separating refrigerant from the contaminants at the purge unit heat exchanger includes:

flowing the purge gas from the permeable membrane to a purge condenser;

urging a purge refrigerant through a purge condenser coil disposed in the purge condenser; and condensing the refrigerant from the purge gas via thermal energy exchange with the purge refrigerant at the purge condenser, thereby separating the refrigerant from the contaminants;

wherein the purge heat exchanger is configured as the purge condenser.

14. The method of claim 13, further comprising urging the purge refrigerant through the purge condenser coil from a condenser outlet of a condenser of the heat transfer fluid circulation loop.

15. The method of claim 13, further comprising flowing the purge refrigerant from the purge condenser coil to the evaporator of the heat transfer fluid circulation loop.

16. The method of claim 10, further comprising venting contaminants to ambient via a vent line at the purge heat exchanger.

* * * * *